United States Patent [19]

Diedershagen et al.

[11] 4,106,879

[45] Aug. 15, 1978

[54] KNOCKOVER ROADWAY MARKER POST

[75] Inventors: Bruno Diedershagen, Wissen, Schonstein; Hans Gubela, Cologne, both of Fed. Rep. of Germany

[73] Assignee: Gubela Strassenausrustungs-GmbH, Cologne, Fed. Rep. of Germany

[21] Appl. No.: 848,087

[22] Filed: Nov. 3, 1977

[30] Foreign Application Priority Data

Nov. 8, 1976 [DE] Fed. Rep. of Germany ..... 2650940
Feb. 3, 1977 [DE] Fed. Rep. of Germany ..... 2704496

[51] Int. Cl.[2] ..... E01F 9/00

[52] U.S. Cl. ..... 404/10; 256/1; 116/63 R; 40/610

[58] Field of Search ..... 404/10, 9; 256/13.1, 256/1; 40/125 H, 125 N; 116/63 R

[56] References Cited

U.S. PATENT DOCUMENTS

| | | | |
|---|---|---|---|
| 2,103,410 | 12/1937 | Frei | 404/10 X |
| 2,141,067 | 12/1938 | Miller | 404/10 |
| 2,949,324 | 8/1960 | Birge | 404/10 X |
| 3,485,201 | 12/1969 | Kelley | 404/10 X |

FOREIGN PATENT DOCUMENTS

| | | | |
|---|---|---|---|
| 236,435 | 3/1964 | Austria | 404/10 |
| 2,037,618 | 3/1972 | Fed. Rep. of Germany | 404/10 |

*Primary Examiner*—Nile C. Byers
*Attorney, Agent, or Firm*—Michael J. Striker

[57] ABSTRACT

A knockover roadway marker post has a base fixable to the ground by means of a stake or the like and having a flat upper surface provided with an upwardly tapering prismatic formation with a non-regular polygonal cross-section at its base. An upright post element comprises an outer reflector-carrying tube snugly fitted over an insert forming at the lower end of the outer tube a downwardly open recess which is congruent to and fittable over the formation of the base with the lower end of the post engaging the flat upper surface of the base around the formation thereof. A tension spring is hooked between the apex of the upwardly tapering formation and the upper end of the insert and is constantly under tension so as to pull the upper post part tightly down onto the base, and to return it to this position should it be knocked over.

20 Claims, 15 Drawing Figures

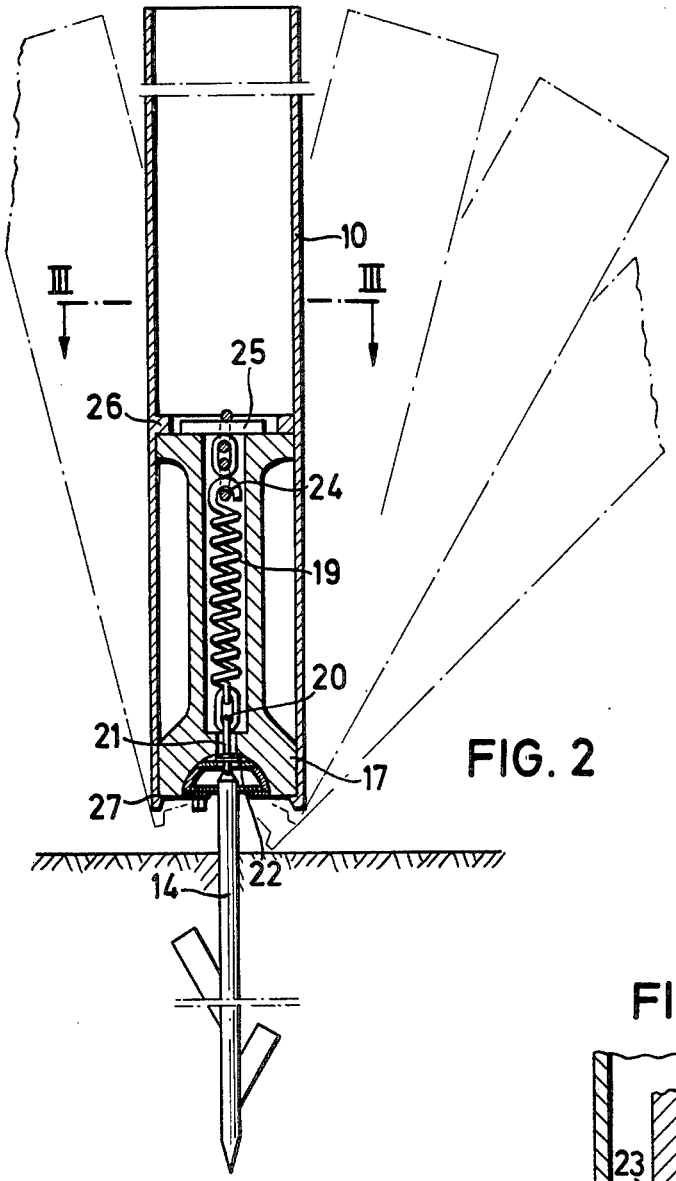
FIG. 2
FIG. 1
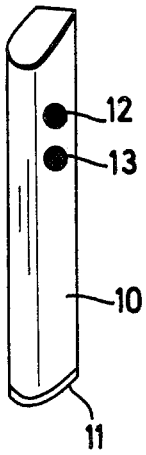
FIG. 4
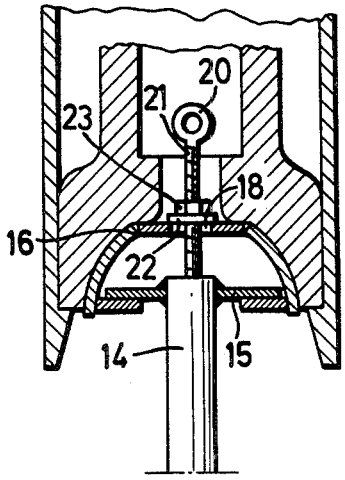
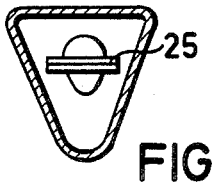
FIG. 3

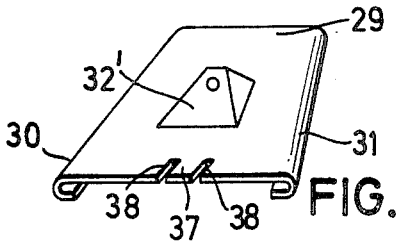
FIG. 8
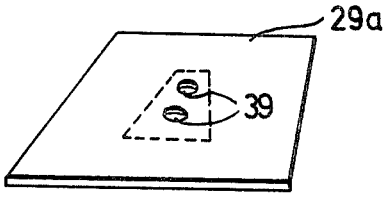
FIG. 9
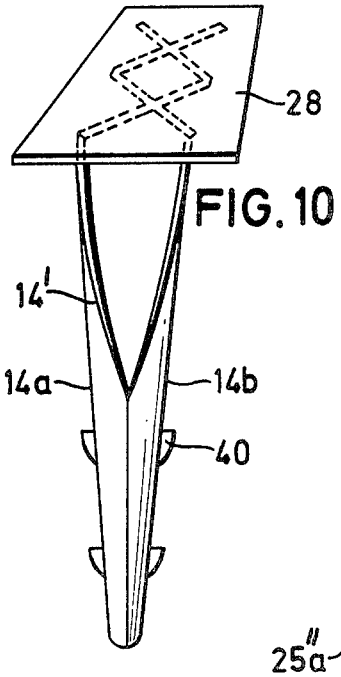
FIG. 10
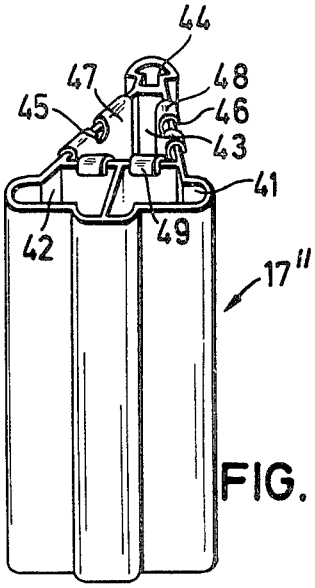
FIG. 11
FIG. 12
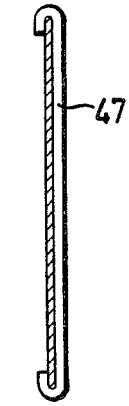
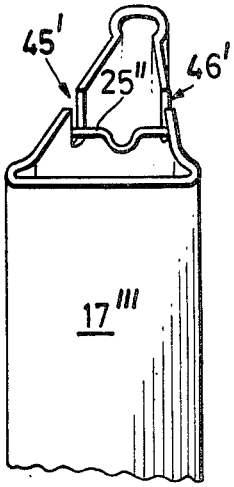
FIG. 13
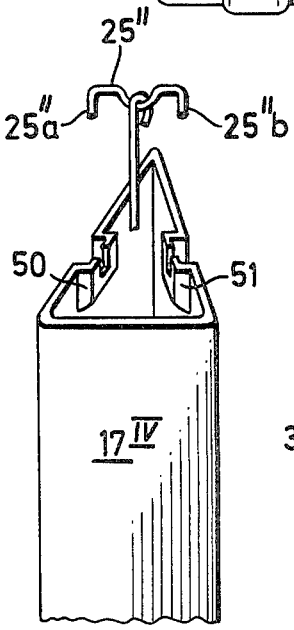
FIG. 14
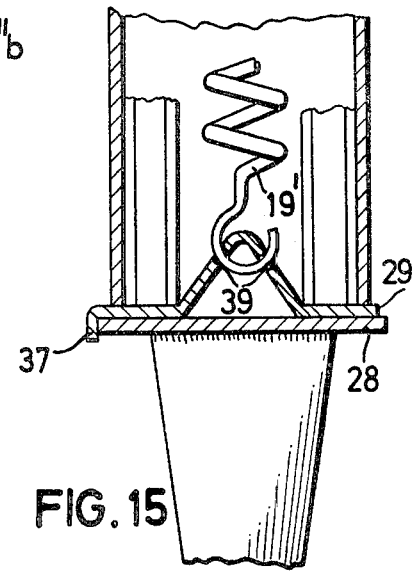
FIG. 15

KNOCKOVER ROADWAY MARKER POST

BACKGROUND OF THE INVENTION

The present invention relates to a knockover roadway marking post. More particularly this invention concerns such a post which normally stands upright, but which can be knocked over and which will automatically return to its upright position.

A knockover marker post of the above-described general type is shown in German Pat. No. 1,277,292. This arrangement has a base that is fixed to the ground and an upper part that is urged by a spring against the base. The spring has one end secured to one of the elements, normally the base element, and another end secured to a cable that is looped through the upper element and secured at its free end to the base element again. The arrangement is so set up that when knocked over in the plane of the holding element constituted by the spring and cable this spring is compressed. Such compression urges the spring back into the upright position. Similarly when knocked over in a direction transverse to this plane the cable is pulled and the arrangement is once again biased back into the upright condition. When hit a glancing blow the device can, however, turn around and wind up the cable and spring so as to jam the arrangement in a position from which it cannot right itself. Furthermore this arrangement has the considerable disadvantage that it is relatively expensive to manufacture and difficult to install.

Another difficulty with the known knockover roadway marker posts is that they frequently do not right themselves in the exact position they were in before being knocked over. Thus a reflector mounted on the side of such a post and directed into the traffic is frequently improperly oriented after the post is knocked over. To this end such reflector posts are frequently made with circular bands of reflectors so that the angular orientation of the post relative to an upright axis becomes irrelevant. Such construction again increases overall costs, something which must be taken into account in an article of this type which must frequently be replaced, as after being knocked over a certain number of times it is inevitable that at least some of the marker posts will be permanently damaged.

SUMMARY OF THE INVENTION

It is therefore an object of the present invention to provide an improved knockover roadway marker post.

Another object is to provide such a post which can be produced at relatively low cost and installed with considerable ease, and which when knocked over rights itself in the same angular position it was in before being knocked over.

These objects are attained according to the present invention in a marker post of the above-described general type having a base fixable to the ground and in turn having an upper surface provided with an upwardly tapering formation. An upright post element has a lower post end formed with a downwardly open recess fittable over this formation with the formation inside the recess and the lower post end engaging the upper surface. A spring is braced between the post element and the base and biases the same together with the lower post end bearing on the upper surface and the formation inside the recess.

According to yet another feature of this invention the recess in the lower end of the post and the upwardly teparing formation are of congruent outline, and are so dimensioned that the formation automatically aligns and centers the post element on the base. The post element can slide along the sloped sides of the formation during such alignment for exact positioning each time the post element is knocked over.

According to yet another feature of this invention the spring is a tension spring hooked between the uppermost portion or apex of the upwardly tapering formation on the base and the post inside same and above the recess formed in the lower end thereof. Such an arrangement insures the immediate righting in proper position of the post element, which slides on the inclined sides of the formation and always automatically returns to the exact position it had before being knocked over.

According to yet another feature of this invention the post element includes an outer tube provided with reflectors of the height desired, and an inner insert fitted tightly into the lower end of the tube and itself connected to the above-mentioned tension spring. This insert itself has a lower end constituting the lower end of the post element, so that the outer tube can be an attractive synthetic-resin extrusion provided with reflectors and having the desired shape.

According to yet another feature of this invention the formation is of polygonal outline at the upper surface of the base. A non-regular polygonal shape is used, preferably a trapezoid, so that the post element can only stand in one position relative to the base. This formation may be stamped out of the plate constituting the upper surface of the base, or may be formed as a welded on element, or as a cage, being formed of a plurality of bars that are bent up and whose ends are welded to the plate forming the base.

The insert may also be generally tubular and have an open upper end formed on diametrically opposite sides with upwardly open notches in which lies a rod or the like to which is hooked the upper end of the tension spring. To this end the insert may be formed with inwardly projecting pockets at each of the notches so that the rod can engage over and around the outside of the insert and still have clearance between itself and the tube forming the covering of the post element.

It is also within the scope of this invention to form the base as a lower plate from which extends a stake that is driven into the ground, and an upper plate releasably engageable with this lower plate. The upper plate and lower plate may both be of trapezoidal outline and the one may be formed with bent over edges for sliding and locking of itself onto the other. To this end at the broad base of the trapezoid one of the plates is formed with a pair of slots that define a tongue that can be bent over to lock the two together once the base is assembled. Such an arrangement allows the lower plate with its stake to be hammered into the ground without damage to the formation that itself is carried on the upper plate and which is only fitted to the lower plate after same is firmly anchored in the ground.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a knockover post according to this invention;

FIG. 2 is a vertical section through the post of FIG. 1;

FIG. 3 is a section taken along line III—III of the post of FIG. 1;

FIG. 4 is a large-scale view of a detail of FIG. 2;

FIG. 8 is a perspective view of an upper base plate of yet another post according to this invention;

FIG. 9 is a perspective view of the plate from which the element of FIG. 8 is stamped;

FIG. 10 is a perspective view of the bottom part of the base for the arrangement of FIG. 8;

FIG. 11 is a perspective view of the post element of the arrangement of FIGS. 8–10;

FIG. 12 is a vertical section through a portion of the wall of the arrangement of FIG. 11;

FIGS. 13 and 14 are perspective views of the tops of further post elements according to this invention; and FIG. 15 is a large-scale view illustrating the assembly of the arrangement of FIGS. 8–12.

DESCRIPTION OF THE PREFERRED EMBODIMENTS

Figure 5:
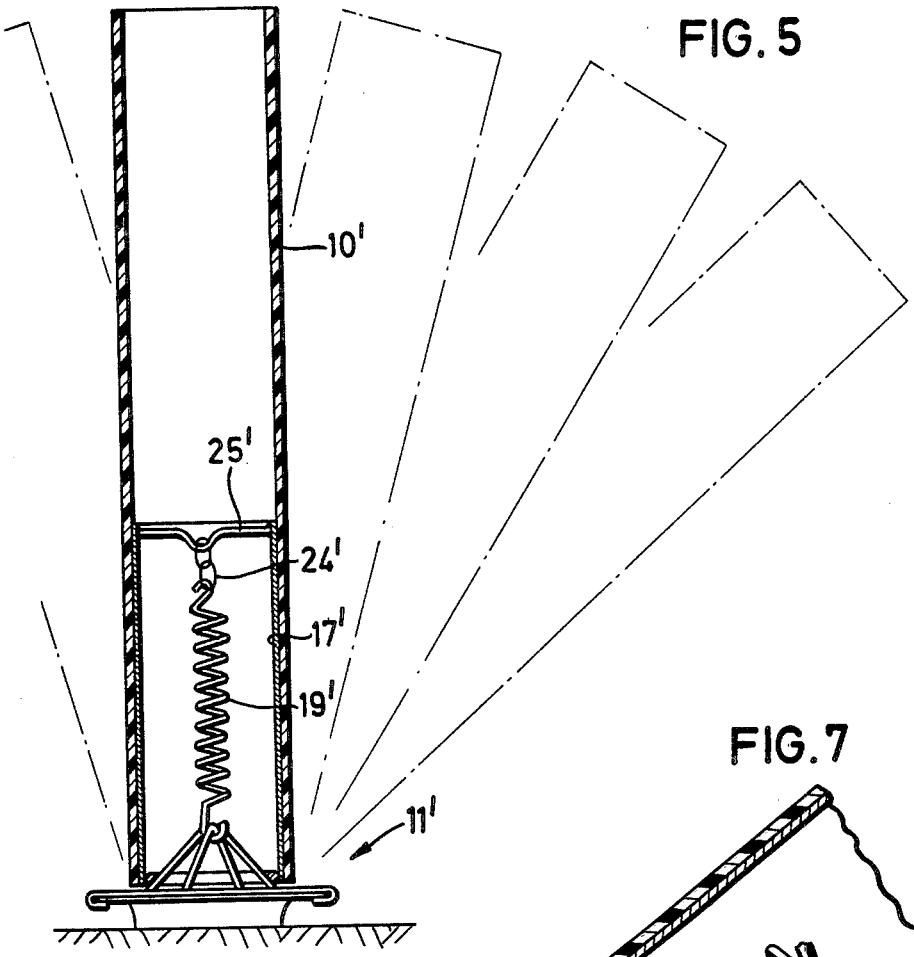
FIG. 5 is a view similar to FIG. 2 of a second post according to this invention.

A knockover post according to this invention and as shown in FIGS. 1–4 comprises a post element formed by an outer tube 10 and an insert 17 and a base 11 formed by a stake 14 and semispherical formation 16. A tension spring 19 is connected between the insert 17 and the base 11, and the outer tube 10 carries a pair of reflectors 12 and 13 that are normally directed into the oncoming traffic.

The tube 10 is formed of thin sheet metal or extruded synthetic-resin material and has an intermediate ridge 26 engaging the top surface of the insert 17 and a lower outwardly and downwardly bevelled ridge 27 that allows this tube 10 to be forced over the massive insert 17 and rigidly connected thereto.

The insert 17 is generally tubular and is of the same cross-sectional shape at its upper and lower ends at the inside of the tube 10. This element 17 may be made of a rigid material, such as cast aluminum or the like.

The stake 14 carries as described above on its upper end a generally semicylindrical element 16 by means of a welded-on plate 15 and an eyebolt 21 that is threaded into the top of the stake 14 and engages through a hole 19 in the top of the element 16. A nut 23 and washer 22 bear on the top of the element 16 to hold the element 16 tightly in place on top of the stake 14.

The spring 19 has a lower end hooked via chain links to an eye 20 at the upper end of the bolt 21. In addition chain links 24 or a similar eye connect the upper end of the tension spring 19 so a transverse rod 25 engaging across the insert 17 and lying on the upper surface thereof. This spring 19 is under constant tension so that the upper post element is always urged into the solid-line position of FIG. 2. When knocked into any of the dot-dash line positions of FIG. 2 it will automatically return to the illustrated solid-line position.

Figure 6:
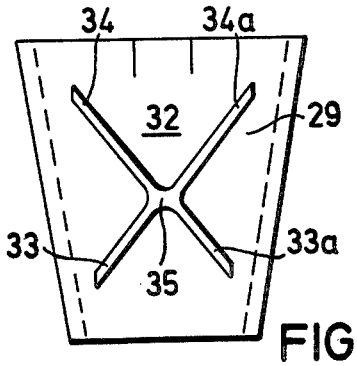
FIG. 6 is a top view of the base of the post of FIG. 5.
Figure 7:
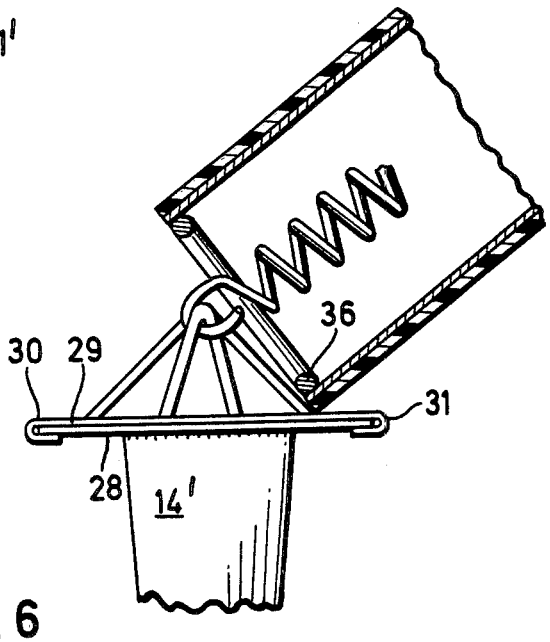
FIG. 7 is a large-scale view showing a portion of the post of FIG. 5 in another position.

In the second embodiment shown in FIGS. 5–7 an outer tube 10' is shown carried on an insert 17' of slim tubular shape, the outer tube 10' being made of synthetic-resin material and the insert 17' being made of heavy sheet metal. In this arrangement, however, the base 11' is formed of a lower plate 28 from which extends downwardly a stake 14' and an upper plate 29 whose edges are bent over at 30 and 31 to hold on the lower plate 28. In addition the plates 28 and 29 are of trapezoidal outline as shown in FIG. 6.

The upper plate 29 has a formation 32 constituted by four rods 33, **33*a*, 34 and 34*a* together forming an apex or crossover point 35 on which may be hooked the lower end of a tension spring 19'. The upper end of this tension spring is connected via links 24' to a transverse rod 25' extending across the upper end of the tubular insert 17'** and welded to the inner wall thereof.

In addition as shown in FIG. 7 a reinforcing ring 36 is welded inside the lower end of the tubular insert 17' and serves mainly to stiffen this element 17'. The outline of the reinforcing ring 36 is trapezoidal as is the overall outline of the formation 32 for automatic positioning and centering of the upper part on the base 11'.

FIG. 8 shows how the upper plate 29 may be formed with a raised formation 32' which is stamped out of a plate **29*a* shown in FIG. 9 at holes 39 thereon. Thus in this arrangement the spring 19' as shown in FIG. 15 may be hooked through the holes 39. In addition FIG. 8 shows how the plate 29 may have slots 38 flanking a tongue 37 that is bent down is also shown in FIG. 5 in the assembled base 11' to hold the two plates 28 and 29 together. FIG. 10 shows how the stake 14' can be formed of a pair of criss-crossing metal sheets 14*a* and 14*b* provided with claws or outwardly projecting formations 40 that hold it tightly in the ground. The lower part of the base shown in FIG. 10 can easily be hammered into the ground, whereupon the top part can be slid on it and the post mounted in place. Indeed the entire upper assembly including the upper plate 29, insert 17' and tube 10' can all be mounted on the lower arrangement shown in FIG. 10** after it is in place.

FIG. 11 shows an upper tube 10'' formed of extruded synthetic-resin material and having three corner compartments 41, 42 and 44 flanking a central parallel compartment 43 provided with reinforcement sheets 47, 48 and 49 bent over as shown in FIG. 12 at their upper and lower ends. In addition the sheets 47 and 48 form opposite notches 45 and 46 for receiving a rod 25'' such as shown in FIG. 14 having bent-down edges **25''*a* and 25''*b*. The upper end of the spring of the arrangement is of course hooked in the central U-shaped portion of this rod 25''**.

It is also possible to form a tube 17''' as shown in FIG. 13 with notches 45' and 46'. In this arrangement the outwardly bulging corners will allow the bent-over ends **25''*a* and 25''*b* to engage outside the insert 17'''** without engaging the inside of a tube to be slipped thereover.

It is also possible to form an insert $17^{IV}$ as shown in FIG. 14 with pockets 50 and 51 at the notches for the ends of the rod 25''.

The outer tube of the upper post element is preferably formed of durable synthetic-resin material. The remainder of the arrangement is made of metal, although the insert 17'', 17''' and $17^{IV}$ of FIGS. 11, 13 and 14 can also be made of synthetic-resin material.

It will be understood that each of the elements described above, or two or more together, may also find a useful application in other types of structures differing from the types described above.

While the invention has been illustrated and described as embodied in a roadway marker post, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A knockover roadway marker post comprising:

a base fixable to the ground and having an upper surface provided with an upwardly tapering formation;

an upright post element having a lower post end formed with a downwardly open recess fittable over said formation with same inside said recess and said lower post end engaging said upper surface; and a spring braced between said post element and said base and biasing same together with said lower post end bearing on said upper surface and said formation inside said recess.

2. The post defined in claim 1, wherein said formation has an uppermost apex, said spring being a tension spring stretched between said apex and said post element above said recess.

3. The post defined in claim 2, wherein said post element includes an insert at said lower end defining said recess.

4. The post defined in claim 3, wherein said insert is at least partially hollow and has an upper insert end, said tension spring passing vertically through said insert and being secured at said upper end thereof.

5. The post defined in claim 4, wherein said formation is generally semispherical.

6. The post defined in claim 4, wherein said formation is generally prismatic and pointed pyramid-fashion.

7. The post defined in claim 6, wherein said formation is of trapezoidal outline at said upper surface.

8. The post defined in claim 6, wherein said formation is of triangular outline at said upper surface.

9. The post defined in claim 4, wherein said formation is constituted by a plurality of bent rods secured to said base.

10. The post defined in claim 4, wherein said formation and said base are unitarily formed out of a single metal sheet.

11. The post defined in claim 10, wherein said formation is formed with at least one hole, said tension spring having a lower spring end hooked into said hole.

12. The post defined in claim 4; further comprising a chain between said spring and said upper end of said insert.

13. The post defined in claim 4, wherein said insert is provided at its said lower end with a stiffening member.

14. The post defined in claim 4, wherein said insert is generally tubular and is formed at its said upper end with a pair of diametrically opposite upwardly open notches, said post further comprising a transverse rod resting in said notches, said spring having an upper end connected to said rod.

15. The post defined in claim 14, wherein said insert is formed at each of said notches with an inwardly projecting pocket.

16. The post defined in claim 4, wherein said insert is formed of synthetic-resin material and has a plurality of upright and separate passages including a central passage of a cross-sectional shape corresponding to the outline and size of said formation at said upper surface.

17. The post defined in claim 4, wherein said base includes a lower plate provided with a stake insertable into the ground and an upper plate releasably secured to said lower plate and forming said surface having said formation.

18. The post defined in claim 17, wherein said plates are generally congruent and trapezoidal, one of said plates having a long base formed with a pair of juxtaposed transverse notches defining a tongue, whereby said tongue can be bent past the other of said plates to secure said plates together.

19. The post defined in claim 1, wherein said recess has a predetermined non-circular outline at said upper surface, said recess having a rim of substantially the same size and shape.

20. The post defined in claim 1, wherein said post element comprises an insert secured to said spring and a tube fitted over and extending upwardly beyond said insert.

* * * * *